US009098008B2

(12) United States Patent
Inami et al.

(10) Patent No.: US 9,098,008 B2
(45) Date of Patent: Aug. 4, 2015

(54) BLOWING DEVICE AND IMAGE FORMING APPARATUS

(75) Inventors: Kazuki Inami, Kanagawa (JP); Yasunori Momomura, Kanagawa (JP); Yuki Nagamori, Kanagawa (JP); Koji Otsuka, Kanagawa (JP); Masafumi Kudo, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 341 days.

(21) Appl. No.: 13/463,080

(22) Filed: May 3, 2012

(65) Prior Publication Data

US 2013/0101309 A1 Apr. 25, 2013

(30) Foreign Application Priority Data

Oct. 21, 2011 (JP) ..... 2011-231299

(51) Int. Cl.

| | |
|---|---|
| ***G03G 21/20*** | (2006.01) |
| ***F24F 7/007*** | (2006.01) |
| ***F24F 7/06*** | (2006.01) |
| ***G03G 15/02*** | (2006.01) |
| *F24F 7/00* | (2006.01) |

(52) U.S. Cl.

CPC ..... *G03G 15/0291* (2013.01); *F24F 7/007* (2013.01); *F24F 7/06* (2013.01); *G03G 21/206* (2013.01); *F24F 2007/001* (2013.01)

(58) Field of Classification Search

CPC ..... G03G 15/0291; G03G 21/206; F24F 2007/001; F24F 7/06; F24F 7/007

USPC ..... 399/92

See application file for complete search history.

(56) References Cited

U.S. PATENT DOCUMENTS

| | | | | |
|---|---|---|---|---|
| 4,745,282 | A * | 5/1988 | Tagawa et al. | 250/326 |
| 5,107,687 | A * | 4/1992 | Candeloro | 62/259.1 |
| 7,236,715 | B2 * | 6/2007 | Nishida et al. | 399/93 |

FOREIGN PATENT DOCUMENTS

| | | | |
|---|---|---|---|
| JP | 10-198128 | A | 7/1998 |
| JP | 2000-137425 | A | 5/2000 |
| JP | 2001-235930 | A | 8/2001 |
| JP | 2001-331016 | A | 11/2001 |

* cited by examiner

*Primary Examiner* — Walter L Lindsay, Jr.
*Assistant Examiner* — Philip Marcus T Fadul
(74) *Attorney, Agent, or Firm* — Sughrue Mion, PLLC

(57) ABSTRACT

A blowing device includes a blower and an air duct including an inlet, an outlet, and a body. The outlet faces a longitudinal portion of an oblong target structure toward which air is blown. The outlet allows air to be discharged in a direction that is substantially perpendicular to a longitudinal direction in which the longitudinal portion extends. The inlet has an opening and the outlet has an oblong opening, and the opening of the inlet and the opening of the outlet having different shapes. The body has a passage space formed therein. Plural restraining portions that restrain airflow are disposed at different positions in the passage space in the direction of airflow. A most downstream one of the restraining portions is formed so as to at least partially cover the passage space with an air-permeable member having plural air passage portions that are distributed the air-permeable member.

19 Claims, 11 Drawing Sheets

BLOWING DEVICE AND IMAGE FORMING APPARATUS

CROSS-REFERENCE TO RELATED APPLICATIONS

This application is based on and claims priority under 35 USC 119 from Japanese Patent Application No. 2011-231299 filed Oct. 21, 2011.

BACKGROUND (i) Technical Field

The present invention relates to a blowing device and an image forming apparatus.

(ii) Related Art

There are image forming apparatuses, which form an image formed from a developer on a recording sheet, including a corona discharge unit that performs corona discharge. The corona discharge unit is used, for example, when charging a latent image carrier such as a photoconductor, when removing charges from the latent image carrier, and when transferring an unfixed image to a recording sheet.

Some corona discharge units are provided with a blowing device that blows air toward components, such as a discharge wire and a grid electrode, in order to prevent wastes, such as paper dust and corona by-products, from adhering to the components. In general, such a blowing device includes a blower that blows air and a duct (air duct) that guides the air to a target structure such as a corona discharge unit.

SUMMARY

According to an aspect of the invention, a blowing device includes a blower that blows air; an air duct that includes an inlet through which the air blown by the blower is taken in, the inlet having an opening, an outlet that faces a longitudinal portion of an oblong target structure toward which the air taken in through the inlet is to be blown, the longitudinal portion extending in a longitudinal direction of the target structure, the outlet allowing the air to be discharged in a direction that is substantially perpendicular to the longitudinal direction, the outlet having an oblong opening extending parallel to the longitudinal portion of the target structure, the opening of the inlet and the opening of the outlet having shapes that are different from each other, and a body in which a passage space through which the air flows from the inlet to the outlet is formed; and plural restraining portions that are disposed at different positions in the passage space of the body of the air duct in a direction of airflow, the restraining portions restraining flow of the air. A most downstream restraining portion, which is disposed at a most downstream position among the restraining portions in the direction of airflow, is formed so as to at least partially cover the passage space at the most downstream position with an air-permeable member having plural air passage portions that are distributed throughout the air-permeable member.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the present invention will be described with reference to the drawings.

First Exemplary Embodiment

Figure 1:
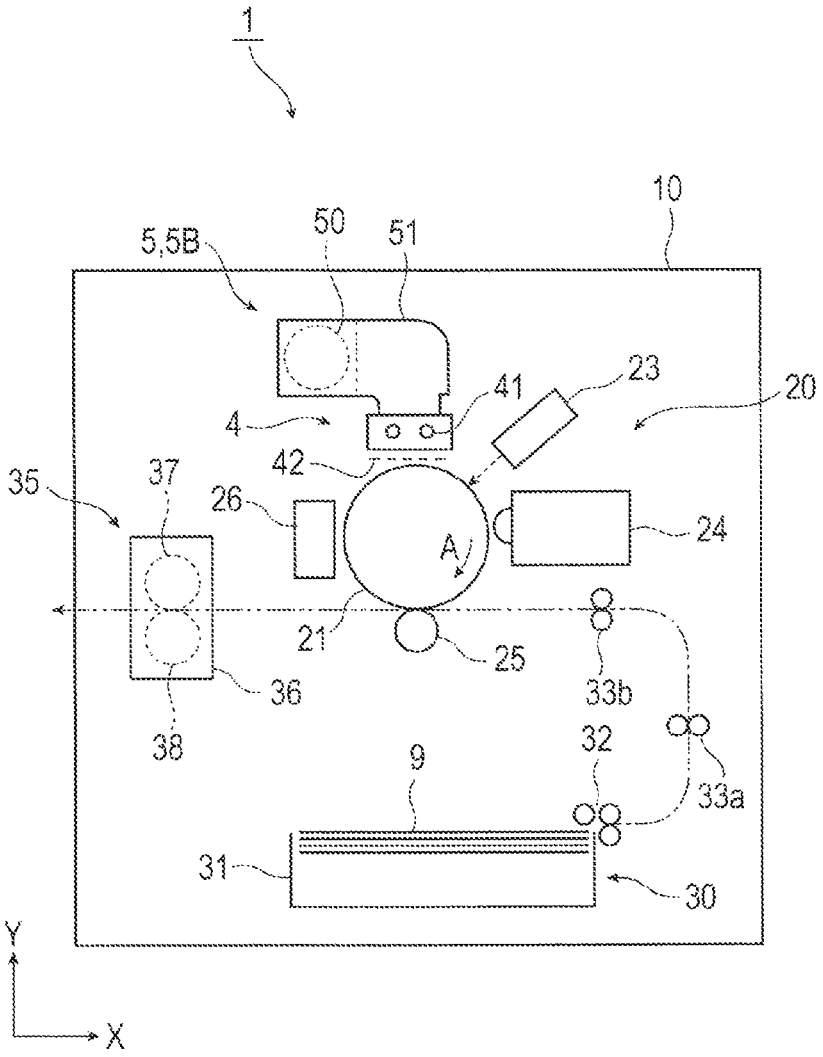
FIG. 1 is a schematic view of an image forming apparatus including a blowing device according to an exemplary embodiment.
Figure 2:
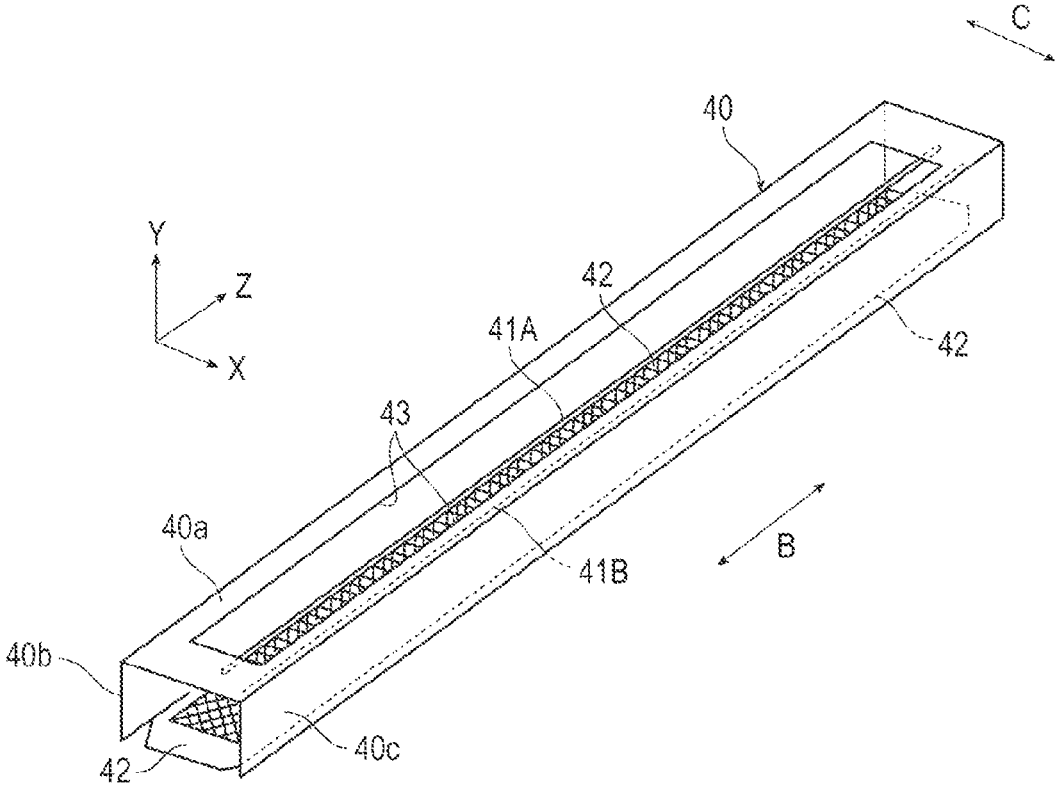
FIG. 2 is a schematic perspective view of a charger, including a corona discharge unit, of the image forming apparatus of FIG. 1.
Figure 3:
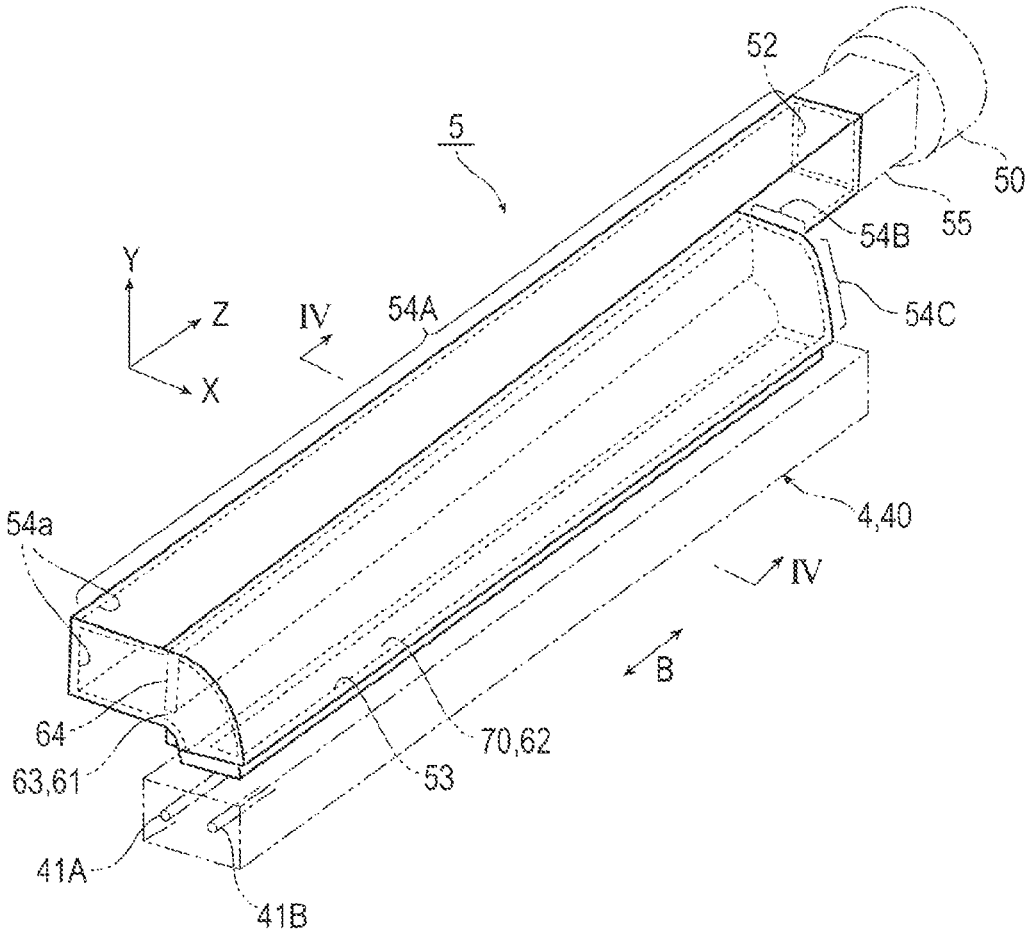
FIG. 3 is a schematic perspective view of a blowing device that is provided to the charger of FIG. 2.

FIGS. 1 to 3 illustrate an image forming apparatus including a blowing device according to a first exemplary embodiment. FIG. 1 is a schematic view of the image forming apparatus. FIG. 2 illustrates a charger of the image forming apparatus, which is a target structure toward which the blowing device is to blow air. FIG. 3 is a schematic view of the blowing device.

As illustrated in FIG. 1, an image forming apparatus 1 includes a housing 10, an image forming unit 20, a sheet feeder 30, and a fixing unit 35, which are disposed in the space inside the housing 10. The housing 10 includes a support frame, an outer cover, and the like. The image forming unit 20 forms a toner image from a toner, which is an example of a developer, and transfers the toner image to a sheet 9, which is an example of a recording member. The sheet feeder 30 contains the sheet 9 and transports the sheet 9 that is supplied to the image forming unit 20. The fixing unit 35 fixes a toner image, which has been formed by the image forming unit 20, to the sheet 9. In the first exemplary embodiment, there is only one image forming unit 20. However, there may be plural image forming units.

The image forming unit 20 employs, for example, a known electrophotographic system. The image forming unit 20 includes a photoconductor drum 21, a charger 4, an exposure device 23, a developing device 24, a transfer device 25, and a cleaner 26. The photoconductor drum 21 rotates in the direction indicated by arrow A (clockwise in FIG. 1). The charger 4 charges the outer peripheral surface of the photoconductor drum 21, which serves as an image forming region, to an appropriate potential. The exposure device 23 irradiates the charged surface of the photoconductor drum 21 with light (shown in FIG. 1 by a broken line with an arrowhead) in accordance with image information (signal) that is input from the outside and thereby forms an electrostatic latent image having a potential difference. The developing device 24 develops the electrostatic latent image to form a toner image by using toner. The transfer device 25 transfers the toner image to the sheet 9. The cleaner 26 removes toner that remains on the photoconductor drum 21 after the toner image has been transferred.

Figure 4:
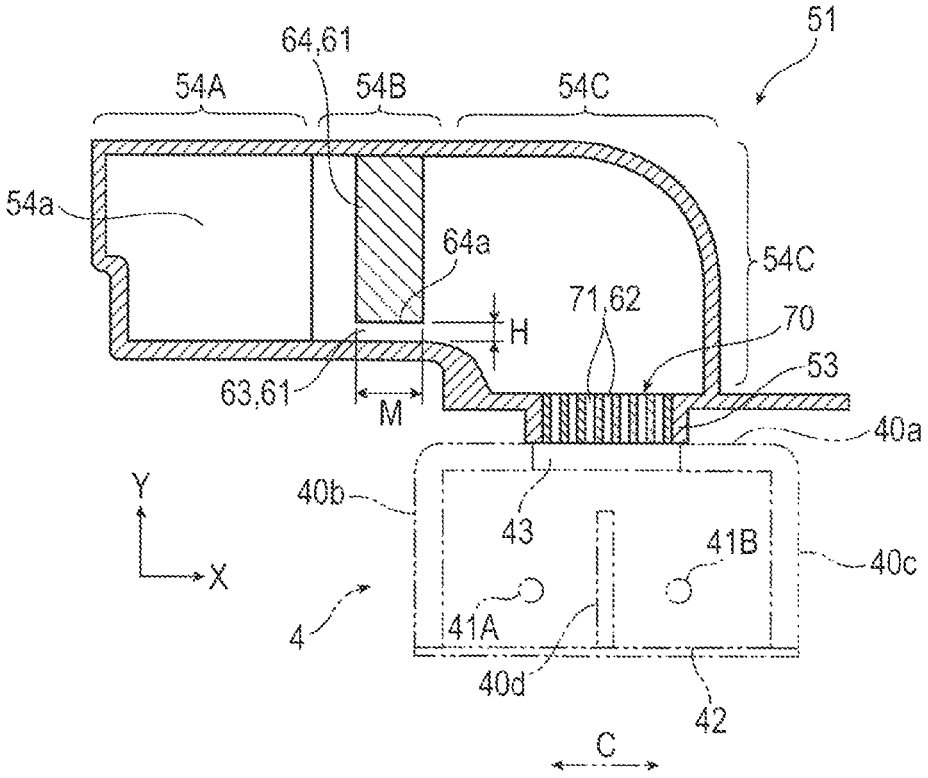
FIG. 4 is a sectional view of the blowing device (air duct) taken along line IV-IV of FIG. 3.

A corona discharge unit is used as the charger 4. As illustrated in FIG. 2 and other figures, the charger 4 is a so-called scorotron corona discharge unit that includes a shield case 40 (covering member), two end supporters (not shown), two corona discharge wires 41A and 41B, and a grid electrode 42 (electric field adjustment plate). The shield case 40 includes a rectangular top panel 40*a* and side panels 40*b* and 40*c*. The side panels 40*b* and 40*c* extend downward from long sides of the top panel 40*a*, which extend along the longitudinal direction B of the top panel 40*a*. The two end supporters are respectively attached to two end portions (short sides) of the shield case 40 in the longitudinal direction B. The two corona discharge wires 41A and 41B extend substantially linearly in the space inside the shield case 40 between the two end supporters. The grid electrode 42 is attached to the shield case 40 so as to cover a lower opening of the shield case 40 at a position between the corona discharge wires 41A and 41B and the outer peripheral surface of the photoconductor drum 21. As illustrated in FIG. 4 and other figures, spaces in which the two corona discharge wires 41A and 41B are disposed are separated from each other by a partition wall 40*d*.

The charger 4 is disposed such that the corona discharge wires 41A and 41B face the outer peripheral surface of the photoconductor drum 21 with an appropriate distance (for example, a discharge gap) therebetween and the discharge wires 41A and 41B are present in at least an image forming region of the photoconductor drum 21 along the axial direction of the photoconductor drum 21. The charger 4 is configured such that, when the image forming apparatus 1 forms an image, an electric power supply (not shown) applies a charging potential to (a space between the photoconductor drum 21 and) the discharge wires 41A and 41B.

While the charger 4 is used, the corona discharge wires 41A and 41B and the grid electrode 42 become contaminated as substances (wastes) such as paper dust of the sheet 9, corona by-product generated by the corona discharge, and toner additives adhere to them. As a result, corona discharge may not be sufficiently and uniformly performed, and defective charging such as nonuniform charging may occur. For this reason, the charger 4 is provided with a blowing device 5 that blows air toward the discharge wires 41A and 41B and the grid electrode 42 to prevent wastes from adhering to the discharge wires 41A and 41B and the grid electrode 42. An opening 43, through which air is taken in from the blowing device 5, is formed in the top panel 40*a* of the shield case 40 of the charger 4. The opening 43 has a rectangular shape. The details of the blowing device 5 will be described below.

The sheet feeder 30 includes a sheet container 31 and a feeding device 32. The sheet container 31 is, for example, a tray or a cassette for holding a stack of plural sheets 9 that have, for example, appropriate sizes and characteristics and that are used to form images thereon. The feeding device 32 feeds the sheets 9, which are contained in the sheet container 31, one by one to a transport path when it becomes necessary to feed the sheet 9. There may be plural sheet containers 31 in accordance with the modes of use. In FIG. 1, the alternate long and short dash line with an arrowhead shows a sheet transport path along which the sheet 9 is transported. The sheet transport path includes pairs of sheet transport rollers 33*a* and 33*b*, a transport guide member (not shown), and the like.

The fixing unit 35 includes a housing 36 having a sheet inlet and a sheet outlet, and a rotary heating member 37 and a rotary pressing member 38 that are disposed in the housing 36. The rotary heating member 37 is roller-shaped or belt-shaped, and the surface of the rotary heating member 37 is heated to an appropriate temperature and maintained at the temperature. The rotary pressing member 38 is roller-shaped or belt-shaped, extends substantially in the axial direction of the rotary heating member 37, and is rotated while being in contact with the rotary heating member 37 with an appropriate pressure. The fixing unit 35 fixes a toner image to the sheet 9 while the sheet 9, to which the toner image has been transferred, passes a fixing region between the rotary heating member 37 and the rotary pressing member 38.

The image forming apparatus 1 forms an image as follows. Here, a basic image forming operation of forming an image on one side of the sheet 9 will be described as an example.

When a control device or the like of the image forming apparatus 1 receives an instruction to start forming an image, the photoconductor drum 21 of the image forming unit 20 starts rotating, and the charger 4 charges the outer peripheral surface of the photoconductor drum 21 to an appropriate potential with a predetermined polarity. At this time, a charging potential is applied to the corona discharge wires 41A and 41B of the charger 4 to cause corona discharge while an electric field is formed between the discharge wires 41A and 41B and the outer peripheral surface of the photoconductor drum 21, and thereby the outer peripheral surface of the photoconductor drum 21 is charged to an appropriate potential. The charging potential of the photoconductor drum 21 is adjusted through the grid electrode 42.

The exposure device 23 exposes the charged outer peripheral surface of the photoconductor drum 21 with light in accordance with image information, and thereby an electrostatic latent image having an appropriate potential difference is formed. Subsequently, when the electrostatic latent image formed on the photoconductor drum 21 passes the developing device 24, the electrostatic latent image is developed to form a visible toner image from toner, which is supplied from a developing roller 24*a* and which has been charged with an appropriate polarity.

As the photoconductor drum 21 rotates, the toner image formed on the photoconductor drum 21 is transported to a transfer position at which the photoconductor drum 21 faces the transfer device 25. The sheet 9 is transported from the sheet feeder 30 to reach the transfer position at this timing, and the transfer device 25 transfers the toner image to the sheet 9. After the toner image has been transferred, the cleaner 26 cleans the outer peripheral surface of the photoconductor drum 21.

The sheet 9, to which the toner image has been transferred by the image forming unit 20, is removed from the photoconductor drum 21 and transported into the fixing unit 35. The sheet 9 is heated and pressed while the sheet 9 passes through the fixing region between the rotary heating member 37 and the rotary pressing member 38 in the fixing unit 35, and thereby the toner image is fused and fixed to the sheet 9. After the toner image has been fixed to the sheet 9, the sheet 9 is discharged from the fixing unit 35, transported to a sheet output tray (not shown) that is disposed, for example, outside of the housing 10, and held on the sheet output tray.

Thus, a color image is formed from a single color toner on one side of the sheet 9, and the basic image forming operation is finished. When an instruction to form plural images is received, the process described above is repeated for the number of the images.

Next, the blowing device 5 will be described.

As illustrated in FIGS. 1 and 3 and other figures, the blowing device 5 includes a blower 50 and an air duct 51. The blower 50 includes a fan that blows air. The air duct 51 guides the air blown by the blower 50 and discharges the air toward the charger 4.

The blower 50 is, for example, a radial-flow fan that is controlled so as to blow an appropriate amount of air. As illustrated in FIGS. 3 to 6, the air duct 51 includes an inlet 52, an outlet 53, and a body 54. The inlet 52 takes in air blown by the blower 50. The outlet 53 is disposed so as to face a longitudinal portion (the top panel 40*a* of the shield case 40) of the charger 4 extending in the longitudinal direction B, toward which the air taken in from the inlet 52 is to be blown. The outlet 53 discharges the air in a direction that is perpendicular to the longitudinal direction B. The body 54 has a passage space 54*a* through which air flows from the inlet 52 to the outlet 53.

The body 54 of the air duct 51 includes an intake passage 54A, a first bent passage 54B, and a second bent passage 54C. The intake passage 54A is angular pipe-shaped and has one end portion that serves as the inlet 52 and the other end portion that is closed, and the entirety of the intake passage 54A extends in the longitudinal direction B of the charger 4. The first bent passage 54B is angular pipe-shaped and extends from a part of the intake passage 54A near the other end portion of the intake passage 54A such that the width of the passage space is increased and such that the passage space is bent substantially perpendicularly in substantially the horizontal direction (parallel to the X-axis). The second bent passage 54C extends from an end portion of the first bent passage 54B such that the width of the passage space is maintained substantially constant and such that the passage space is bent substantially vertically downward (parallel to the Y-axis) toward the charger 4. The outlet 53 is formed at an end portion of the second bent passage 54C. The outlet 53 has a rectangular shape and, in sectional view, is slightly narrower than the passage space at the end portion (although the lengths of the rectangular shapes of the outlet 53 and the passage space in the longitudinal direction are the same). The width (in the longitudinal direction B) of the passage space 54*a* in the first bent passage 54B is substantially the same as that of the passage space 54*a* in the second bent passage 54C.

The opening of the inlet 52 of the air duct 51 has a substantially square shape. A connection duct 55, which connects the inlet 52 to the blower 50, is attached to the inlet 52, so that air blown by the blower 50 may flow from the blower 50 to the inlet 52 of the air duct 51 (FIG. 3). The opening of the outlet 53 of the air duct 51 has an oblong shape (for example, rectangular shape) that extends parallel to a longitudinal portion of the charger 4 extending in the longitudinal direction B. Therefore, the openings of the inlet 52 and the outlet 53 of the air duct 51 have shapes that are different from each other. Here, the phrase "the openings have shapes that are different from each other" also refers to the case where the inlet 52 and the outlet 53 have the same shape and different areas (where they are similar to each other).

Because the inlet 52 and the outlet 53 have different shapes, there is a part in the body 54 of the air duct 51, between the inlet 52 and the outlet 53, at which the sectional shape of the passage space 54*a* is changed. In the air duct 51, the sectional shape of the passage space 54*a* is changed from a substantially square shape in the intake passage 54A to a rectangular shape in the first bent passage 54B. The height of the rectangular shape is the same as that of the substantially square shape, and the width in the horizontal direction is larger than that of the substantially square shape. In other words, the passage space 54*a* has a sectional shape such that the width of the sectional shape increases sharply from the intake passage 54A to the first bent passage 54B.

In the case where the air duct 51 has a part at which the sectional shape of the passage space 54*a* sharply changes, turbulence of airflow such as a vortex or flow separation tend to occur at the part, and therefore the velocity of air discharged from the outlet 53 has a tendency to become nonuniform even if air is taken in through the inlet 52 with a uniform velocity. This tendency, in that the velocity of air discharged from the outlet finally becomes nonuniform, occurs in a similar way if the direction of airflow in the air duct 51 changes, regardless of whether the sectional shape of the passage space 54*a* is changed or not.

Figure 12A:
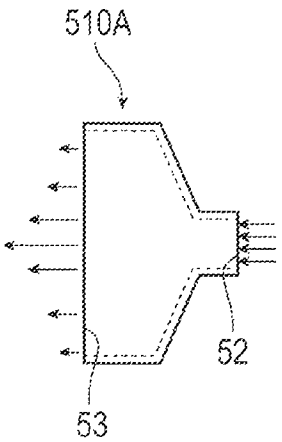
FIGS. 12A to 12D are top views of modifications of the air duct.
Figure 12B:
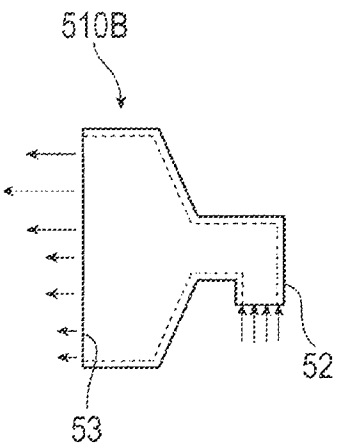
Figure 12C:
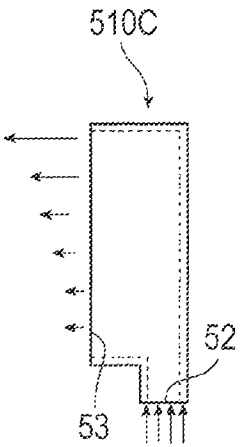
Figure 12D:
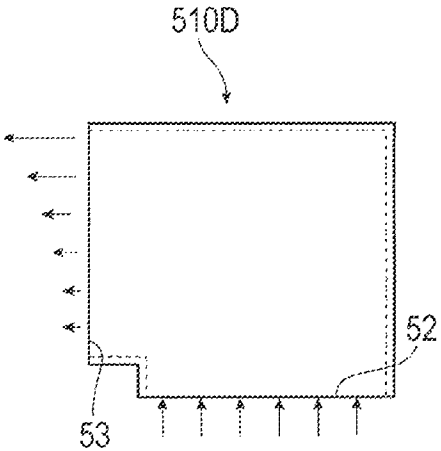

FIGS. 12A to 12C respectively illustrate air ducts 510A to 510C, which are examples of an air duct in which the shapes of the openings of the inlet 52 and the outlet 53 are different from each other. In each of FIGS. 12A to 12C, the distribution of the velocity of air taken into the inlet 52 of a corresponding one of the air ducts 510A to 510C and the distribution of the velocity of air discharged through the outlet 53 is represented by the lengths of arrows. In FIGS. 12A to 12D, the air ducts 510A to 51D are seen from above. The arrows having the same length represent the same air velocity, and the arrows having different lengths represent different air velocities. The broken lines represent (side walls of) passage spaces in the ducts. The air ducts 510B and 510C each have a shape such that the direction of airflow is changed in the duct and at least one of the shape and the area of the passage space is changed. The air duct 510D illustrated in FIG. 12D has a shape such that the openings of the inlet 52 and the outlet 53 have the same shape (and the same area) and only the direction of air flow is changed in the duct.

As illustrated in FIGS. 3 to 6 and other figures, the air duct 51 of the blowing device 5 includes restraining portions 61 and 62 that restrain airflow. The two restraining portions 61 and 62 are disposed at different positions in the passage space 54*a* in the body 54 with respect to the direction of airflow. The restraining portion 62 (hereinafter referred to as the "most downstream restraining portion 62") is disposed at the most downstream position in the passage space 54*a* (including the outlet 53) in the direction of airflow. The most downstream restraining portion 62 at least partially covers the passage space (including the opening of the outlet 53) at the most downstream position with an air-permeable member 70 having plural air passage portions 71.

The restraining portions 61 is disposed in an upstream part of the passage space 54*a* of the first bent passage 54B in the direction of airflow (indicated by arrows E1), which is upstream of the most downstream restraining portion 62 in the direction of airflow. The restraining portion 61 has a gap 63 extending in a direction parallel to the longitudinal direction of the opening of the outlet 53 (which is the same as the longitudinal direction B of the charger 4).

The restraining portion 61 according to the first exemplary embodiment is formed by disposing a plate-shaped partition member 64 in the passage space 54*a* of the first bent passage 54B without changing the outer shape of the first bent passage 54B. To be specific, the partition member 64 is disposed such that the partition member 64 closes an upper part of the passage space 54*a* of the first bent passage 54B and such that a lower end 64*a* of the partition member 64 is spaced apart from the bottom of the passage space 54*a* by a predetermined distance H. Thus, the gap 63 is formed in a lower part of the passage space 54*a*. The partition member 64 may be integrally formed with the duct 51 from the same material. Alternatively, the partition member 64 may be formed from a material different from that of the duct 51.

The height H, the path length M, and the width W (length in the longitudinal direction) of the gap 63 are determined with consideration of the following factors: to maximally uniformize the velocity of air that flows into the first bent passage 54B from the intake passage 54A, the size (volume) of the duct 51, and the flow rate of air that needs to flow through the duct 51 or to the charger 4. For example, the height H of the gap 63 need not be constant in the width direction, but may be uniformly or partially changed on the basis of such factors.

The most downstream restraining portion 62 is formed by covering the passage space (opening) at an end portion (outlet 53) of the second bent passage 54C with the air-permeable member 70 including the air passage portions 71.

Figure 6:
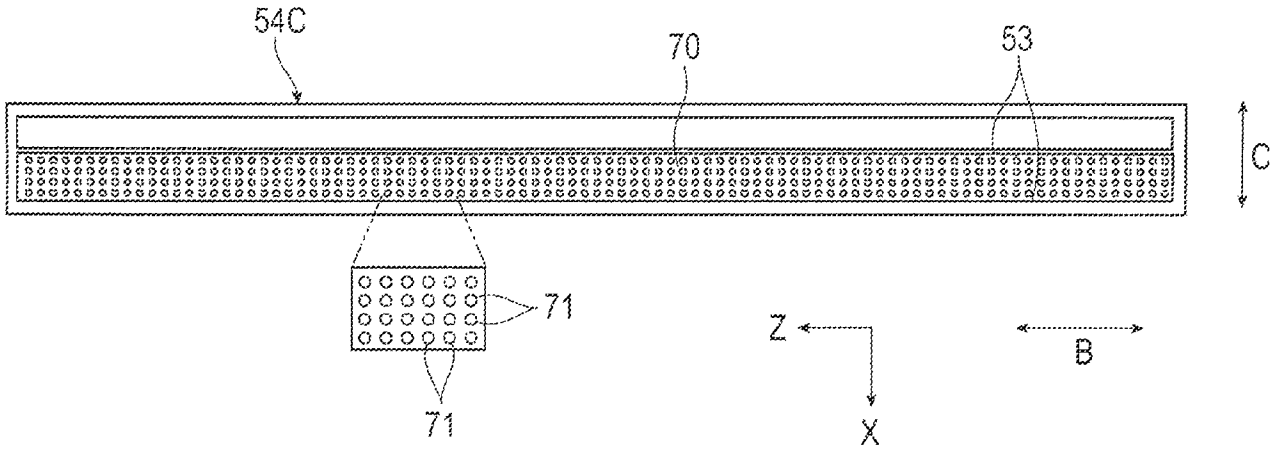
FIG. 6 is a bottom view of the air duct of the blowing device of FIG. 3, illustrating an outlet of the air duct.

As illustrated in FIG. 6, each of the air passage portions 71 is a through-hole having a substantially circular opening and linearly extending through the air-permeable member 70. For example, there are four rows of the air passage portions 71. In each of the rows, the air passage portions 71 are arranged in the longitudinal direction B of the opening region of the outlet 53 at a regular pitch, and the four rows are arranged at the same regular pitch in the transversal direction C. Thus, the air passage portions 71 are distributed throughout the entire area of the passage space at the end of the second bent passage 54C or throughout the entire opening of the outlet 53. That is, the air-permeable member 70 according to the first exemplary embodiment is a plate-shaped member having the air passage portions 71 (holes) that are distributed throughout the air-permeable member 70. The air passage portions 71 may be substantially evenly distributed throughout the opening region of the outlet 53 (at a substantially uniform density). However, the density of the distribution of the air passage portions 71 may be slightly nonuniform, provided that air is not discharged nonuniformly through the outlet 53.

The air-permeable member 70 may be integrally formed from a material the same as that of the duct 51 or may be formed from a material different from that of the duct 51. The shape and size the opening of each of the air passage portions 71 (holes), the length of each of the air passage portions 71, and the density of the distribution of the air passage portions 71 are determined with consideration of the following factors: to maximally uniformize the velocity of air that flows through the second bent passage 54C and out of the outlet 53, the size (volume) of the duct 51, and an appropriate flow rate of air that needs to flow through the duct 51 or to the charger 4.

Hereinafter, the operation of the blowing device 5 will be described.

First, the blower 50 of the blowing device 5 rotates and blows an appropriate amount of air at a preset timing such as when the image forming apparatus 1 forms an image. Air E, which is blown by the blower 50, passes through the connection duct 55 and the inlet 52 of the air duct 51, and is taken into the passage space 54*a* in the body 54.

Figure 5:
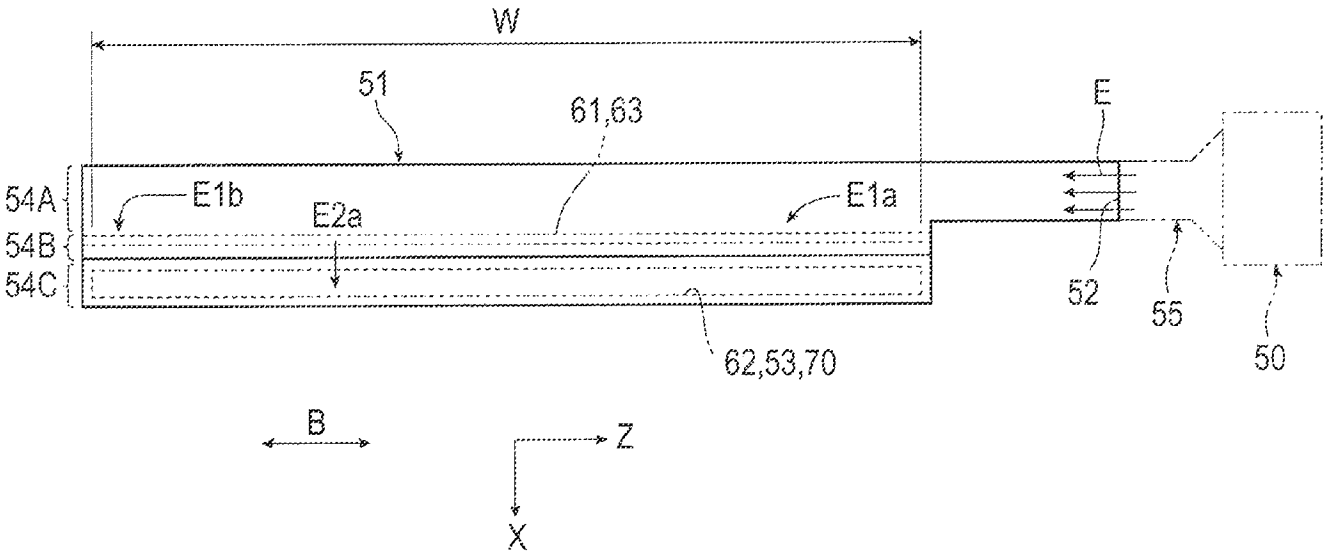
FIG. 5 is a schematic top view of the blowing device of FIG. 3.

As illustrated in FIG. 5, the air E, which has been taken into the air duct 51, passes through the passage space 54*a* of the intake passage 54A and flows into the passage space 54*a* of the first bent passage 54B (see, for example, arrows E1*a* and E1*b* in FIG. 5). Air E1, which has flowed into the first bent passage 54B, passes trough the gap 63 of the first restraining portion 61 and the direction airflow is bent substantially perpendicularly (see the direction of arrow E2*a* in FIG. 5), and flows into the passage space 54*a* of the first bent passage 54B (see, for example, the directions of arrows E2*a* and E2*b* in FIG. 7).

At this time, when air E2 flows through the gap 63 of the first restraining portion 61, the flow of the air is restrained (the pressure of the air is increased) by the first restraining portion 61, and thereby the air flows uniformly into the passage space 54*a* of the first bent passage 54B through the gap 63. Moreover, when the air E2 flows into the passage space 54*a* of the first bent passage 54B, the direction of airflow is aligned with a direction that is substantially perpendicular to the longitudinal direction B of the outlet 53 while the air passes through the gap 63 of the restraining portion 61.

Then, the air E2, which has flowed into the passage space 54*a* of the first bent passage 54B, moves to the passage space 54*a* of the second bent passage 54C, which extends so as to be continuous with the first bent passage 54B and substantially perpendicularly bent from the first bent passage 54B. The air E2, which has flowed into the passage space 54*a* of the second bent passage 54C, is temporarily retained in the passage space 54*a* of the second bent passage 54C, which has a volume larger than those of the passage space 54*a* of the intake passage 54A and the gap 63, and thereby nonuniformity in the velocity of the air is reduced.

Figure 7:
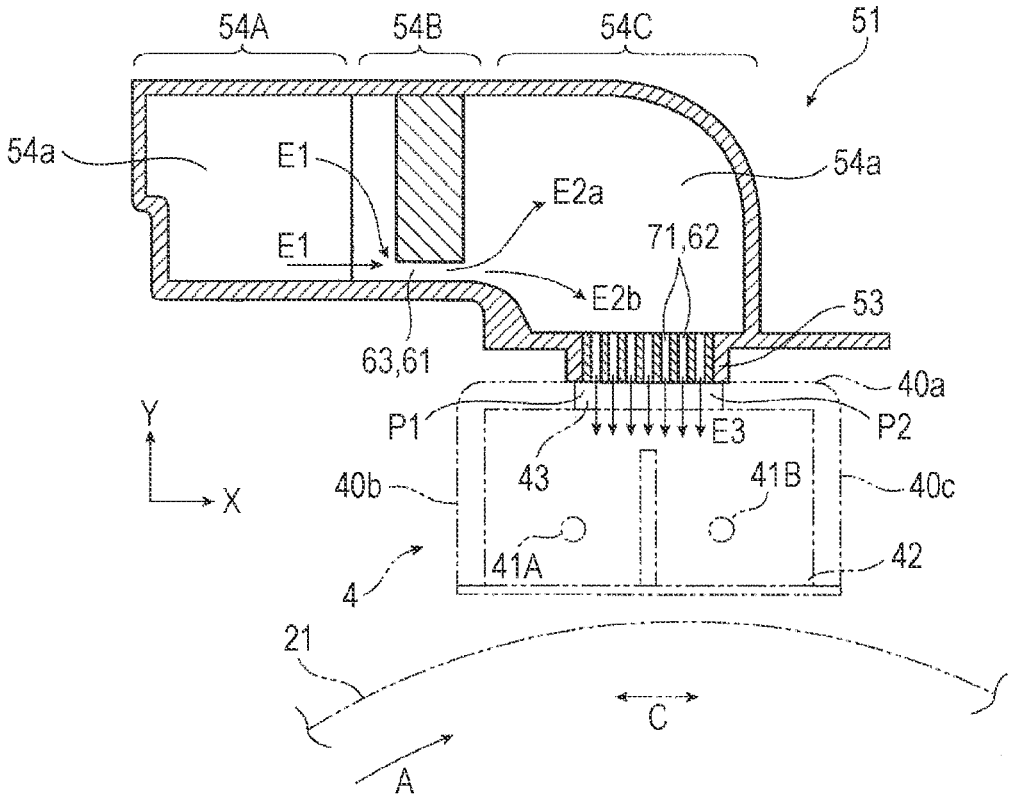
FIG. 7 illustrates the operation of the blowing device of FIG. 3.

As illustrated in FIG. 7, the air E2, which has flowed into and retained in the second bent passage 54C, passes through the air passage portions 71 (holes) in the air-permeable member 70 of the most downstream restraining portion 62, which is disposed at an end of the second bent passage 54C or at the outlet 53, and the air is finally blown out from the outlet 53 (see the lengths and the directions of arrows E3 in FIG. 7).

At this time, the flows of air E3 are restrained (the pressure of the air is increased) while the air passes through the air passage portions 71 of the air-permeable member 70 having an area smaller than the opening area of the outlet 53, and the air E3 is blown out from the outlet 53. Because the air E3 passes through the air passage portions 71, which are formed under the same conditions so as to be distributed throughout the entire area of the outlet 53, the air E3 is uniformly blown out from substantially the entire area of the outlet 53. The air E3 is blown out from the outlet 53 in a direction substantially perpendicular to the longitudinal direction of the outlet 53.

Thus, the direction of flow of air E3 passing through each of the air passage portions 71 of the air-permeable member 70 is substantially perpendicular to the longitudinal direction of the outlet 53, and the velocities of the flows of air are substantially uniform. Moreover, the distribution of the flows of air E3 through the outlet 53 is substantially uniform in the longitudinal direction B and in the transversal direction C of the opening shape (rectangle) of the outlet 53.

As illustrated in FIG. 7, the air E3, which has been blown out from the outlet 53 of the air duct 51, passes through the opening 43 formed in the top panel 40*a* of the shield case 40 of the charger 4, and is blown into the case 40. Then, the air is blown toward the two corona discharge wires 41A and 41B, which are respectively disposed at the centers of the two spaces inside the case 40 divided by the partition wall 40*d*, and toward the grid electrode 42, which is attached to a lower opening portion of the case 40. The air that is blown toward the corona discharge wires 41A and 41B and the grid electrode 42 have been discharged through the outlet 53 of the air duct 51 so as to have a substantially uniform velocity in the longitudinal direction and in the transversal direction of the outlet 53. Therefore, the air is substantially uniformly blown toward the two discharge wires 41A and 41B and the grid electrode 42.

Thus, wastes such as paper dust, toner additives, and corona by-products, which may adhere to the two discharge wires 41A and 41B and the grid electrode 42, are kept away from the discharge wires 41A and 41B and the grid electrode 42. As a result, with the charger 4, occurrence of abnormal charging such as nonuniform charging that may be caused by wastes nonuniformly adhering to the discharge wires 41A and 41B and the grid electrode 42 is prevented, and thereby the outer peripheral surface of the photoconductor drum 21 is more uniformly charged (with respect to the axial direction and the circumferential direction that is the rotation direction A of the photoconductor drum 21). The image forming unit 20 including the charger 4 forms a toner image while preventing occurrence of an image defect (such as nonuniformity density), which may caused by abnormal charging such as nonuniform charging, and finally forms a fine image on the sheet 9.

Figure 8:
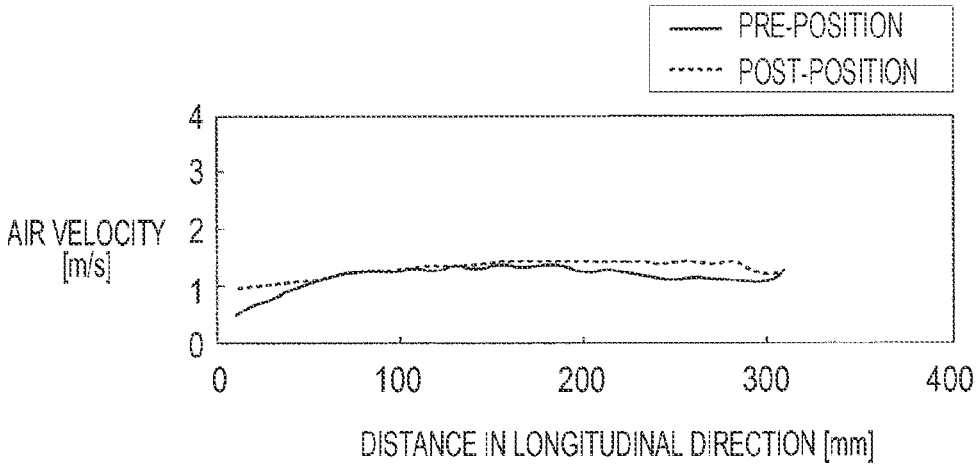
FIG. 8 is a graph representing the result of an evaluation test in which the air velocity at the outlet of the air duct of the blowing device of FIG. 3 is measured.

FIG. 8 is a graph representing the result of an evaluation test in which the characteristics of the blowing device 5 (the distribution of the air velocity at the outlet 53 of the air duct 51) is examined.

In the evaluation test, air is blown by the blower 50 such that the average air velocity at the outlet 53 of the air duct 51 is about 1.0 m/s, and the distribution of air velocity in the longitudinal direction B of the outlet 53 is measured. As illustrated in FIG. 7, an end position P1 (pre-position) is located on an upstream side of the outlet 53 in the rotation direction A of the photoconductor drum 21 and an end position P2 (post-position) is located in a downstream side of the outlet 53 in the rotation direction A of the photoconductor drum 21. The air velocity is measured by moving an air velocity sensor (Cambridge AccuSense F900) in the longitudinal direction B at the pre-position P1 and at the post-position P2.

The air duct 51 has a shape illustrated in FIGS. 3 to 6. The opening of the inlet 52 has a substantially square shape with the dimensions 22 mm×23 mm, and the opening of the outlet 53 has a rectangular shape with the dimensions 17.5 mm×350 mm. The restraining portion 61 has a path length M of 8 mm and a width W of 345 mm, and the gap 63 has a height H that is inclined in the range of 1 to 2 mm. The air-permeable member 70 of the most downstream restraining portion 62 has air passage portions 71, each having a diameter of 1 mm and a length of 3 mm, that are distributed with a density of about 0.42 per $mm^2$ (42 per $cm^2$).

As illustrated in FIG. 8, the air velocity at the outlet 53 of the air duct 51 is about 1.0 m/s, which is approximately the same as the target value, along the entire length of the outlet 53 in the longitudinal direction B. The air velocities at the pre-position P1 and the post-position P2 of the outlet 53 are approximately the same along the longitudinal direction B of the outlet 53. This shows that the air velocity in the transversal direction C of the outlet 53 is substantially uniform.

Second Exemplary Embodiment

Figure 9:
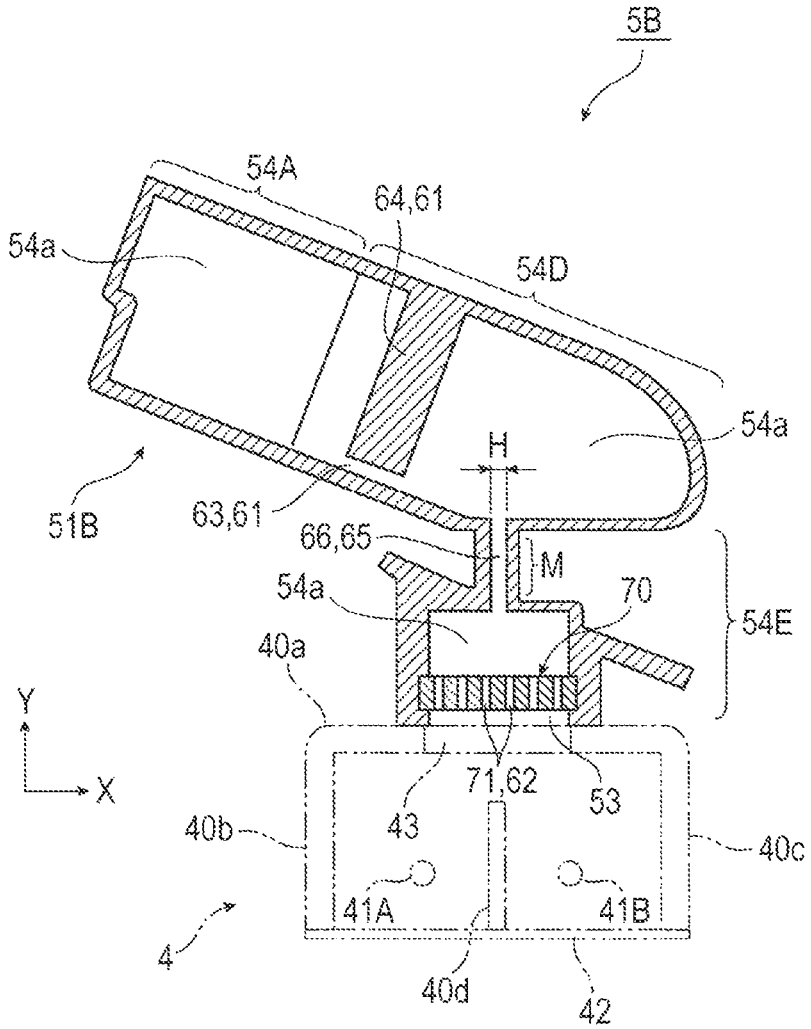
FIG. 9 illustrates a blowing device (air duct) according to a second exemplary embodiment.

FIG. 9 illustrates a blowing device 5B according to a second exemplary embodiment and an air duct 51B of the blowing device 5B.

The blowing device 5B has a structure the same as that of the blowing device 5 according to the first exemplary embodiment, except that the structure of the air duct 51B is partially different from that of the air duct 51 of the blowing device 5. As illustrated in FIG. 9, the difference between the air duct 51B and the air duct 51 according to the first exemplary embodiment is that the air duct 51B includes a first bent passage 54D and a second bent passage 54E, which have structures different from those of the first bent passage 54B and the second bent passage 54C, and that the air duct 51B further includes a third restraining portion 65. Hereinafter, the same components will be denoted by the same numerals and description of such components will be omitted unless it is necessary.

The first bent passage 54D of the air duct 51B differs from the first bent passage 54B of the air duct 51 in that the air duct 51B has a shape such that the height of a downstream portion of the passage space 54*a* of the air duct 51B decreases downstream in the direction of airflow. The second bent passage 54E of the air duct 51B differs from the second bent passage 54C of the air duct 51 in the following two respects. First, the second bent passage 54E extends toward the charger 4 from substantially the middle position at the bottom of the first bent passage 54D in the direction of airflow so as be bent downward while maintaining the width of the passage space. Second, the outlet 53 is disposed at an end of the second bent passage 54E, and the outlet 53 has an opening having a (rectangular) shape that is the same as the sectional shape of the passage space 54*a* at the end of the second bent passage 54E.

The third restraining portion 65 is disposed between the first restraining portion 61 and the most downstream restraining portion 62 in the direction of airflow in the passage space 54*a*. To be specific, the third restraining portion 65 is disposed in an upstream part of the passage space 54*a* of the second bent passage 54E. The restraining portion 65 has a gap 66 extending in a direction parallel to the longitudinal direction B of the opening of the outlet 53.

In the second exemplary embodiment, the restraining portion 65 is formed by decreasing the width of the second bent passage 54E so as to form the gap 66 (narrow passage) at substantially the center of the passage space 54*a* of the second bent passage 54E.

As in the case of the gap 63 of the first restraining portion 61, the height H, the path length M, and the width W of the gap 66 are determined with consideration of the following factors: to maximally uniformize the velocity of air that flows from the first bent passage 54D to the second bent passage 54E, the size (volume) of the duct 51, and the flow rate of air that needs to flow through the duct 51 or to the charger 4.

Hereinafter, the operation of the blowing device 5B will be described.

Figure 10:
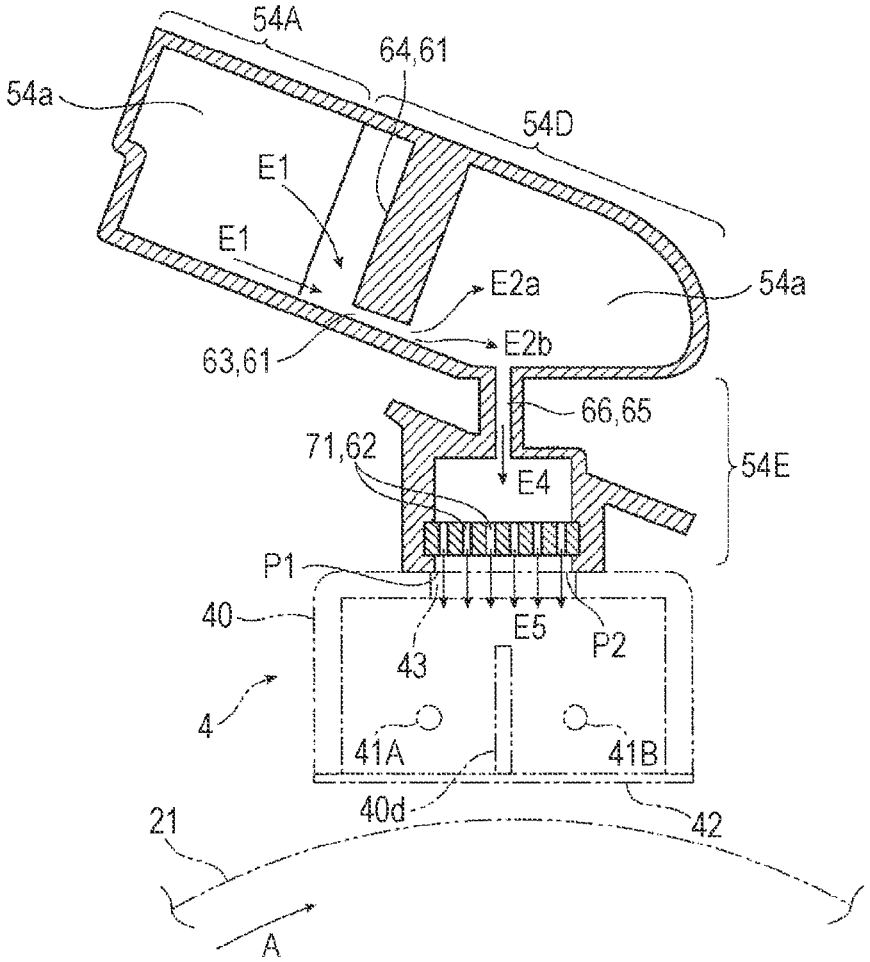
FIG. 10 illustrates the operation of the blowing device of FIG. 9.

In the blowing device 5B, the blower 50 takes in air E through the inlet 52 to the intake passage 54A of the air duct 51 (see the directions of arrows E1 in FIG. 10). Subsequently, the air flows into the first bent passage 54D (see the directions of arrows E2*a* and E2*b* in FIG. 10). Air E2, which has flowed into the first bent passage 54D, passes through the gap 63 of the first restraining portion 61, and thereby the conditions of the air are made substantially the same as those of the air E2, which has flowed into the first bent passage 54B according to the first exemplary embodiment.

As illustrated in FIG. 10, the air E2, which has flowed into the first bent passage 54D, passes through the gap 66 of the third restraining portion 65 of the second bent passage 54E and flows into the passage space 54*a* of the second bent passage 54E (see the direction of arrow E4 in FIG. 10).

At this time, when air E4 flows through the gap 66 of the restraining portion 65, the flow of the air is restrained (the pressure of the air is increased) by the restraining portion 65, and thereby the air flows uniformly into the second bent passage 54E through the gap 66. When the air E4 flows into the passage space 54*a* of the second bent passage 54E, the direction of airflow is more reliably aligned with a direction that is substantially perpendicular to the longitudinal direction B of the outlet 53 while the air passes through the gap 66 of the restraining portion 65. The air E4, which has flowed into the passage space 54*a* of the second bent passage 54E, is temporarily retained in the passage space 54*a* of the second bent passage 54E, which has a volume larger than those of the passage space 54*a* of the first bent passage 54D and the gap 66, and thereby nonuniformity in the velocity of the air is reduced further.

As illustrated in FIG. 10, the air E4, which has flowed into the second bent passage 54E, passes through the air passage portions 71 (holes) in the air-permeable member 70 of the most downstream restraining portion 62, which is disposed at an end of the second bent passage 54E (located slightly upstream of the outlet 53 in the direction of airflow), and the air is finally blown out from the outlet 53 (see the lengths and the directions of arrows E5 in FIG. 10).

At this time, the flows of air E5 are restrained (the pressure of the air is increased) while the air passes through the air passage portions 71 of the air-permeable member 70 having an area smaller than the opening area of the outlet 53, and the air E5 is blown out from the outlet 53. Because the air E5 passes through the air passage portions 71, which are formed under the same conditions so as to be distributed throughout the entire area of the outlet 53, the air E5 is uniformly blown out from substantially the entire area of the outlet 53. The air E5 is blown out from the outlet 53 in a direction substantially perpendicular to the longitudinal direction of the outlet 53.

Thus, the direction of flow of air E5 passing through each of the air passage portions 71 of the air-permeable member 70 is substantially perpendicular to the longitudinal direction of the outlet 53, and the velocities of the flows of air are substantially the same. Moreover, the distribution of the flows of air E5 through the outlet 53 is substantially uniform in the longitudinal direction and in the transversal direction C of the opening shape (rectangle) of the outlet 53.

As illustrated in FIG. 10, the air E5, which has been blown out from the outlet 53 of the air duct 51, passes through the opening 43 formed in the top panel 40*a* of the shield case 40 of the charger 4, and is blown into the case 40. Then, the air is blown toward the two corona discharge wires 41A and 41B, which are respectively disposed at the centers of the two spaces inside the case 40, and toward the grid electrode 42, which is disposed in a lower opening portion of the case 40.

As in the case of the first exemplary embodiment, the air that is blown toward the corona discharge wires 41A and 41B and the grid electrode 42 have been discharged through the outlet 53 of the air duct 51 so as to have a substantially uniform velocity in the longitudinal direction and in the transversal direction of the outlet 53. Therefore, the air is substantially uniformly blown toward the two discharge wires 41A and 41B and the grid electrode 42.

As a result, with the charger 4 including the blowing device 5B, occurrence of abnormal charging such as nonuniform charging that may be caused by wastes nonuniformly adhering to the discharge wires 41A and 41B and the grid electrode 42 is prevented, and thereby the outer peripheral surface of the photoconductor drum 21 is more uniformly charged (with respect to the axial direction and the circumferential direction that is the rotation direction A of the photoconductor drum 21). The image forming unit 20 including the charger 4 forms a toner image while preventing occurrence of an image defect (such as nonuniformity density), which may be caused by abnormal charging such as nonuniform charging, and finally forms a fine image on the sheet 9.

Figure 11:
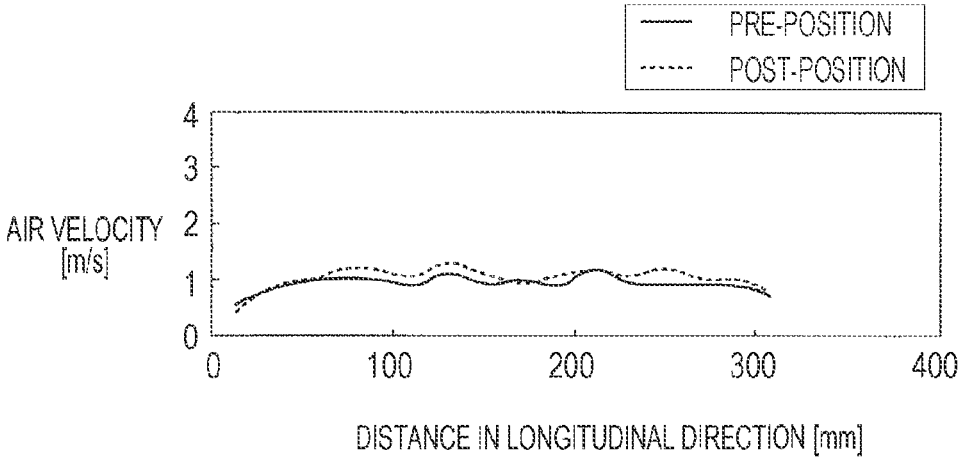
FIG. 11 is a graph representing the result of an evaluation test in which the air velocity at the outlet of the air duct of the blowing device of FIG. 9 is measured.

FIG. 11 is a graph representing the result of an evaluation test in which the characteristics of the blowing device 5B (the distribution of the air velocity at the outlet 53 of the air duct 51B) is examined. The evaluation test is carried out in the same way as that in the first exemplary embodiment.

The air duct 51B has a shape illustrated in FIG. 9. As with the air duct 51 of the blowing device 5 according to the first exemplary embodiment, the opening of the inlet 52 has a substantially square shape with the dimensions 22 mm×23 mm, and the opening of the outlet 53 has a rectangular shape with the dimensions 17.5 mm×350 mm. The restraining portion 61 has a path length M of 6 mm and a width W of 345 mm, and the gap 63 has a height H that is inclined in the range of 1 to 2 mm. The restraining portion 65 has a path length M of 10 mm and a width W of 345 mm, and the gap 66 has a height H of 1 mm. As in the first exemplary embodiment, the air-permeable member 70 of the most downstream restraining portion 62 has the air passage portions 71, each having a diameter of 1 mm and a length of 3 mm, that are distributed with a density of about 0.42 per $mm^2$ (42 per $cm^2$).

As illustrated in FIG. 11, the air velocity at the outlet 53 of the air duct 51B is about 1.0 m/s, which is approximately the same as the target value, along the entire length of the outlet 53 in the longitudinal direction B. The air velocities at the pre-position P1 and the post-position P2 of the outlet 53 are approximately the same along the longitudinal direction B of the outlet 53. This shows that the air velocity in the transversal direction C of the outlet 53 is substantially uniform. With the blowing device 5B according to the present exemplary embodiment, due to the use of the air duct 51B (increase in the number of the restraining portions), the velocity of air discharged from the outlet 53 is made more stable and uniform than in the case of (the air duct 51 of) the blowing device 5 according to the first exemplary embodiment even when the flow rate of air taken into the air duct 51 is increased or decreased.

Comparative Example

Figure 13:
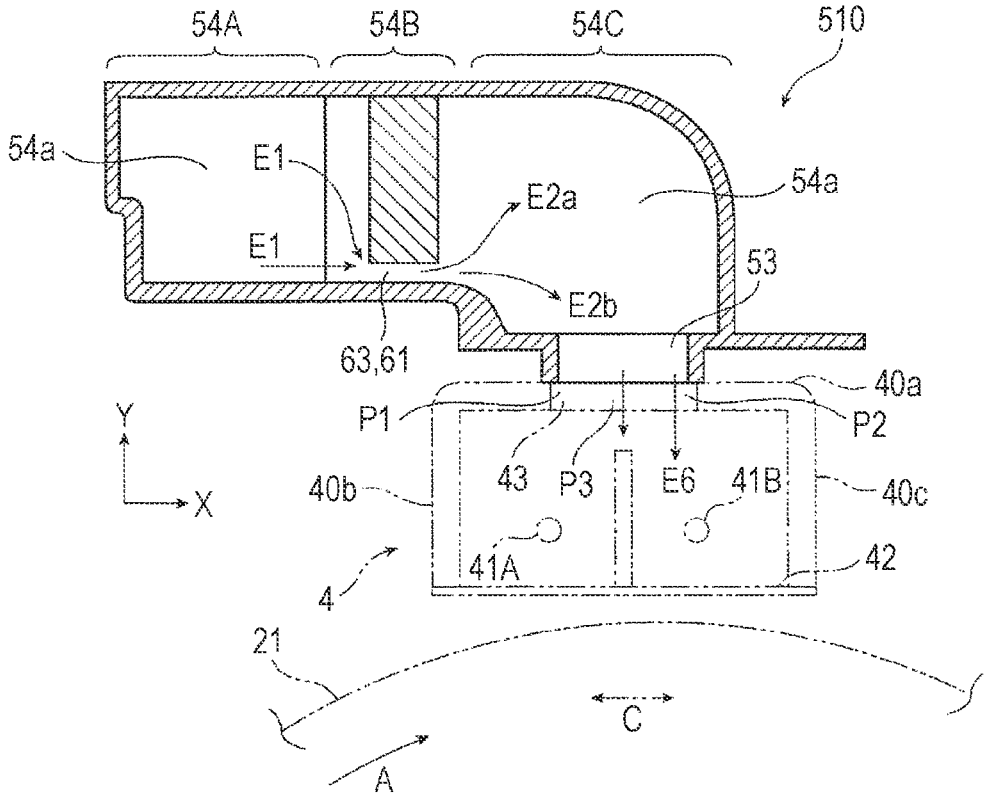
FIG. 13 is a sectional view of a blowing device (air duct) according to a comparative example.

FIG. 13 illustrates an air duct 510 according to a comparative example.

The air duct 510 according to the comparative example differs from the air duct 51 of the blowing device 5 according to the first exemplary embodiment (see FIG. 7) only in that the air-permeable member 70 having the air passage portions 71 is not disposed in the outlet 53. That is, as illustrated in FIG. 13, the outlet 53 of the air duct 510 is formed as a single rectangular opening. FIG. 13 schematically illustrates air E6 that is discharged from the outlet 53.

Figure 14:
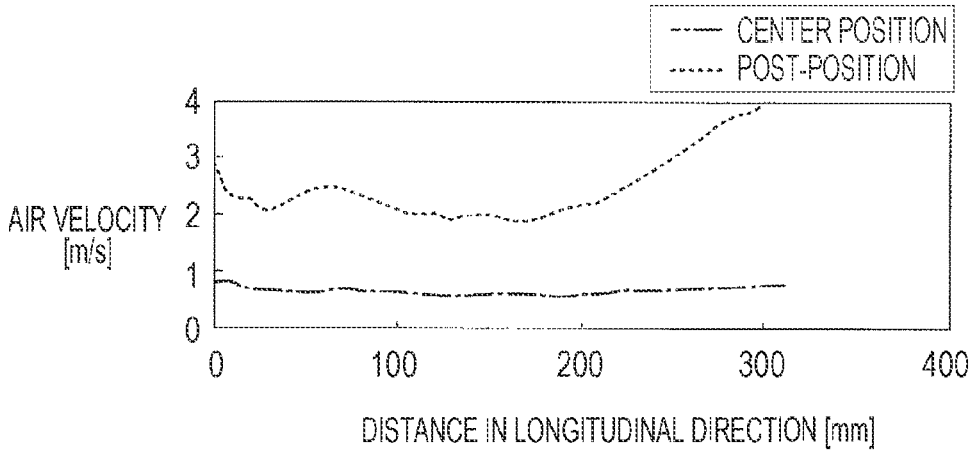
FIG. 14 is a graph representing the result of an evaluation test in which the air velocity at the outlet of the air duct of the blowing device of FIG. 13 is measured.

FIG. 14 is a graph representing the result of an evaluation test in which the characteristics of the air duct 510 of the blowing device according to the comparative example (the distribution of the air velocity at the outlet 53) is examined. The evaluation test is carried out in the same way as that of the first exemplary embodiment except for the following respect. With the air duct 510 according to the comparative example, the air velocity at the pre-position P1 of the outlet 53 is approximately zero. For this reason, the air velocity is measured at the post-position P2 and at a center position P3 that is in the middle of the pre-position P1 and the post-position P2 in the rotation direction A of the photoconductor drum 21 as illustrated in FIG. 13.

As clearly seen from FIG. 14, with the air duct 510, in particular, the air velocity at the post-position P2 of the outlet 53 considerably varies in the longitudinal direction B, and the air velocity in the transversal direction C of the outlet 53 is not uniform. As described above, the air velocity at the pre-position P1 of the outlet 53 is approximately zero and the airflow is negligible at this position.

Other Exemplary Embodiments

The air duct 51 according to the first exemplary embodiment is provided with the two restraining portions 61 and 62, and the air duct 51B according to the second exemplary embodiment is provided with the three restraining portions 61, 62, and 65. However, there may be four or more restraining portions. Any of the restraining portions, including the most downstream restraining portion, may be disposed at a position in the passage space 54*a* of the body 54 of the duct 51 at which the sectional shape of the passage space 54*a* is changed or at a position that is (directly) downstream of a position at which the direction of airflow is changed in the passage space 54*a*.

In the first and second exemplary embodiments, the most downstream restraining portion 62 includes the air-permeable member 70 having the air passage portions 71 (holes), which are substantially evenly distributed throughout the opening region of the outlet 53. However, the most downstream restraining portion 62 may include an air-permeable member 70 including, for example, a porous member, such as non-woven cloth used as a filter (having air passage portions 71 that are through-holes with irregular shapes).

The shape of the entirety of the air duct 51 is not limited to those described in the first and second exemplary embodiments. An air duct 510 having another shape, such as any of the air ducts 510A to 510C illustrated in FIGS. 12A to 12D, may be used.

The charger 4, to which the blowing device 5 (or 5B) is provided, may be a so-called corotron corona discharge unit that does not include the grid electrode 42. The charger 4 may include only one corona discharge wire 41 or three or more corona discharge wires 41. A target structure toward which the blowing device 5 blows air may be a corona discharge unit that eliminates charges of the photoconductor drum 21 or a corona discharge unit that charges or eliminates charges of an object other than the photoconductor drum. Alternatively, the target structure may be an oblong structure, other than a corona discharge unit, toward which air needs to be blown.

The configuration of the image forming apparatus 1, such as the method of forming an image, is not particularly limited as long as the image forming apparatus 1 includes an oblong target structure toward which the blowing device 5 (5B) needs to blow air.

As appropriate, the image forming apparatus 1 may be an image forming apparatus that forms an image that is not formed from a developer.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A blowing device comprising:

a blower configured to blow air;

an air duct comprising:

an inlet through which the air blown by the blower is taken in, the inlet having an opening, an outlet facing a longitudinal portion of an oblong target structure toward which the air taken in through the inlet is to be blown, the longitudinal portion extending in a longitudinal direction of the target structure, the outlet configured to allow the air to be discharged in a direction that is substantially perpendicular to the longitudinal direction, the outlet having an oblong opening extending parallel to the longitudinal portion of the target structure, the opening of the inlet and the opening of the outlet having shapes that are different from each other, and a body in which a passage space through which the air flows from the inlet to the outlet is formed, the outlet provided at a most downstream end of the body; and a plurality of restraining portions disposed at different positions in the passage space of the body of the air duct in a direction of airflow, the restraining portions restraining flow of the air, wherein a most downstream restraining portion of the plurality of restraining portions, which is disposed at a most downstream position among the restraining portions in the direction of airflow, is configured to at least partially cover the passage space at the most downstream position with an air-permeable member having a plurality of air passage portions that are distributed throughout the air-permeable member, the plurality of air passage portions of the air permeable member provided at the outlet of the air duct, each of the air passage portions comprising an opening which faces a surface of the longitudinal portion of the oblong target structure, and wherein the opening of at least one of the restraining portions disposed upstream of the air passage portion extends parallel with the longitudinal direction of the oblong target structure and the opening of the at least one of the restraining portions is larger than each opening of each of the air passage portions.

2. The blowing device according to claim 1, wherein the most downstream restraining portion is configured to cover the outlet of the air duct with the air-permeable member.

3. The blowing device according to claim 1, wherein at least one of the restraining portions disposed upstream of the most downstream restraining portion in the direction of airflow comprises a gap in the passage space, the gap extending parallel to the longitudinal direction of the opening of the outlet.

4. The blowing device according to claim 3, wherein the body of the air duct comprises a bent passage through which the air passes after the direction of airflow has been bent, and wherein the restraining portion having the gap is disposed in an upstream portion of the bent passage in the direction of airflow.

5. An image forming apparatus comprising:

an oblong target structure toward which air is to be blown; and a blowing device configured to blow air to a longitudinal portion of the target structure, wherein the blowing device is the blowing device according to claim 1.

6. The image forming apparatus according to claim 5, wherein the target structure is a corona discharge unit.

7. The blowing device according to claim 1, wherein the air passage portions comprise at least two openings along the longitudinal direction of the target structure and at least two openings along a direction substantially perpendicular to the longitudinal direction of the target structure.

8. The blowing device according to claim 1, wherein each of the air passage portions is configured to configured to blow the air at the target structure.

9. The blowing device according to claim 8, wherein the target structure is a corona discharge unit.

10. A blowing device comprising:

a blower configured to blow air;

an air duct comprising:

an inlet through which the air blown by the blower is taken in, the inlet having an opening, an outlet facing a longitudinal portion of an oblong target structure toward which the air taken in through the inlet is to be blown, the longitudinal portion extending in a longitudinal direction of the target structure, the outlet configured to allow the air to be discharged in a direction that is substantially perpendicular to the longitudinal direction, the outlet having an oblong opening extending parallel to the longitudinal portion of the target structure, the opening of the inlet and the opening of the outlet having shapes that are different from each other, and a body in which a passage space through which the air flows from the inlet to the outlet is formed, the outlet provided at a most downs earn end of the body; and a plurality of restraining portions disposed at different positions in the passage space of the body of the air duct in a direction of airflow, the restraining portions restraining flow of the air, wherein a most downstream restraining portion of the plurality of restraining portions, which is disposed at a most downstream position among the restraining portions in the direction of airflow, is configured to at least partially cover the passage space at the most downstream position with an air-permeable member having a plurality of air passage portions that are distributed throughout the air-permeable member, the plurality of air passage portions of the air-permeable member provided at the outlet of the air duct, wherein at least one of the restraining portions disposed upstream of the most downstream restraining portion in the direction of airflow comprises an opening in the passage space, wherein the opening of the at least one of the restraining portions is larger than each opening of each of the air passage portions, and wherein the opening of at least one of the restraining portions disposed upstream of the air passage portion extends parallel with the longitudinal direction of the oblong target structure.

11. The blowing device according to claim 10, wherein the most downstream restraining portion is configured to cover the outlet of the air duct with the air-permeable member.

12. The blowing device according to claim 10, wherein at least one of the restraining portions disposed upstream of the most downstream restraining portion in the direction of airflow comprises a gap in the passage space, the gap extending parallel to the longitudinal direction of the opening of the outlet.

13. The blowing device according to claim 12, wherein the body of the air duct comprises a bent passage through which the air passes after the direction of airflow has been bent, and wherein the restraining portion having the gap is disposed in an upstream portion of the bent passage in the direction of airflow.

14. An image forming apparatus comprising:

an oblong target structure toward which air is to be blown; and a blowing device configured to blow air to a longitudinal portion of the target structure, wherein the blowing device is the blowing device according to claim 10.

15. The image forming apparatus according to claim 14, wherein the target structure is a corona discharge unit.

16. The blowing device according to claim 10, wherein the air passage portions comprise at least two openings along the longitudinal direction of the target structure and at least two openings along a direction substantially perpendicular to the longitudinal direction of the target structure.

17. The blowing device according to claim 10, wherein each of the air passage portions comprises an opening which faces a surface of the longitudinal portion of the oblong target structure.

18. The blowing device according to claim 10, wherein each of the air passage portions is configured to configured to blow the air at the target structure.

19. The blowing device according to claim 18, wherein the target structure is a corona discharge unit.

* * * * *